US007627995B1

(12) United States Patent
Yoder

(10) Patent No.: US 7,627,995 B1
(45) Date of Patent: Dec. 8, 2009

(54) POST FRAME BUILDING BRACKET AND METHOD OF USE

(76) Inventor: Jason L. Yoder, 27453 CR 150, Nappanee, IN (US) 46550

( * ) Notice: Subject to any disclaimer, the term of this patent is extended or adjusted under 35 U.S.C. 154(b) by 0 days.

(21) Appl. No.: 12/029,107

(22) Filed: Feb. 11, 2008

Related U.S. Application Data

(60) Provisional application No. 60/889,329, filed on Feb. 12, 2007.

(51) Int. Cl.
*E02D 27/42* (2006.01)

(52) U.S. Cl. ..... 52/170; 52/292; 248/519; 256/66.14

(58) Field of Classification Search ..... 52/745.17, 52/170, 292; 248/519; 256/65.14
See application file for complete search history.

(56) References Cited

U.S. PATENT DOCUMENTS

| | | | | | |
|---|---|---|---|---|---|
| 772,928 | A * | 10/1904 | Dunlap | 52/298 |
| 4,543,757 | A * | 10/1985 | Cosgrove | 52/295 |
| 5,568,909 | A * | 10/1996 | Timko | 248/519 |
| 5,720,134 | A * | 2/1998 | Kurtz | 52/170 |
| 5,913,778 | A * | 6/1999 | Hying et al. | 52/40 |
| 6,672,017 | B2 * | 1/2004 | Larson | 52/170 |
| 6,684,580 | B1 * | 2/2004 | Hull | 52/170 |
| 6,886,296 | B1 * | 5/2005 | John et al. | 52/170 |
| 6,929,571 | B2 * | 8/2005 | Jesch et al. | 473/479 |
| 6,988,700 | B2 * | 1/2006 | Cote | 248/519 |
| 7,219,873 | B2 * | 5/2007 | Harwood | 248/519 |
| 2007/0084137 | A1 * | 4/2007 | Pasto | 52/170 |
| 2007/0158526 | A1 * | 7/2007 | Platt | 248/519 |

* cited by examiner

*Primary Examiner*—Richard E Chilcot, Jr.
*Assistant Examiner*—Alp Akbasli
(74) *Attorney, Agent, or Firm*—Botkin & Hall, LLP

(57) ABSTRACT

The post bracket of this invention is for use in constructing post frame buildings. The post bracket has a first side plate, a second side plate, a back plate, and may have a front catch plate. The catch plate is located between the first and second side plates. The bracket fits over a subgrade post to form a subgrade post assembly. The subgrade post assemblies extend into the ground and are initially supported upon and attached to skirt boards which outline the foot print for the building. The subgrade posts are anchored in the ground. After the posts are anchored in the ground, upper posts are placed in and pivotally engaged in the post brackets. Adjacent posts are attached to each other to form a wall section. The wall section is then pivoted upward by pivoting the upper posts in the brackets.

2 Claims, 3 Drawing Sheets

FIG.1
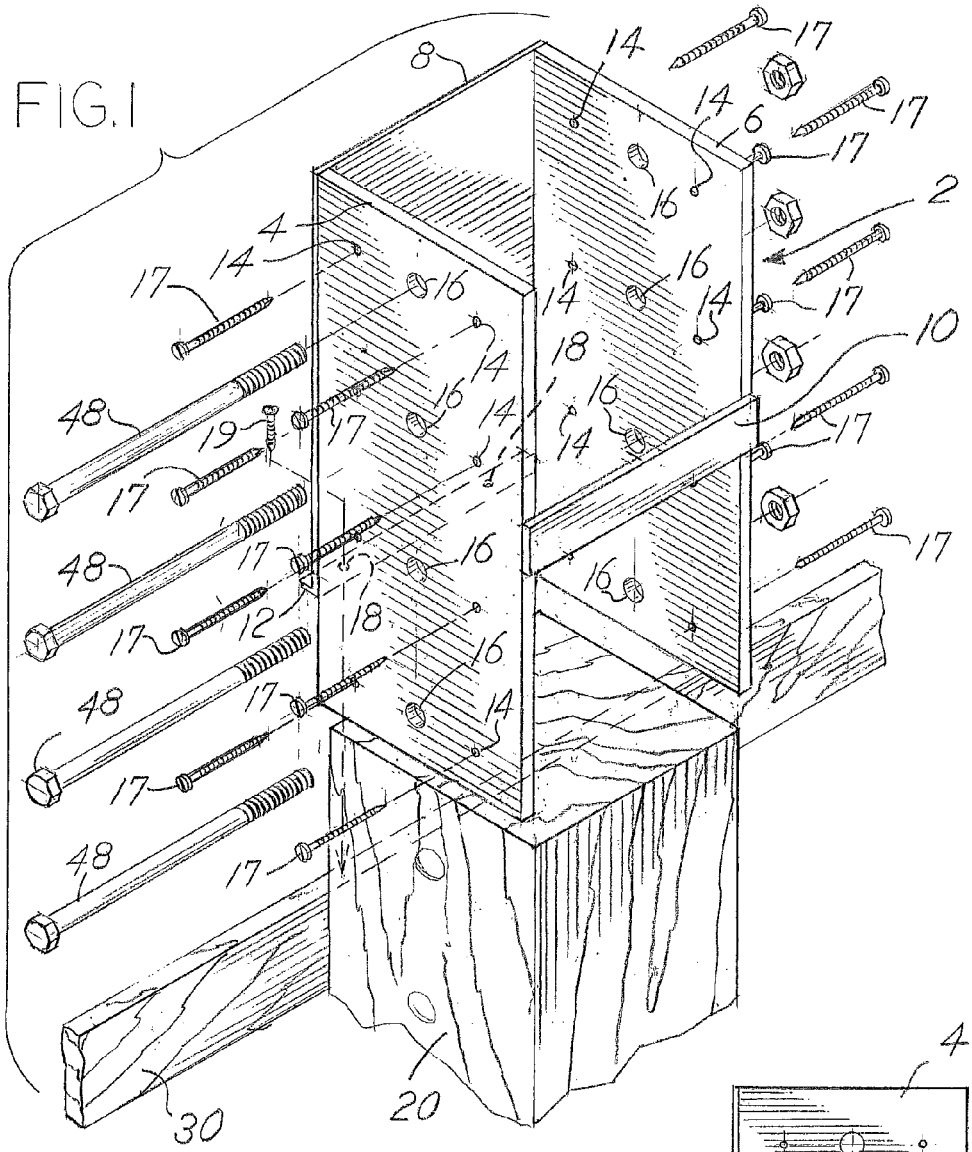
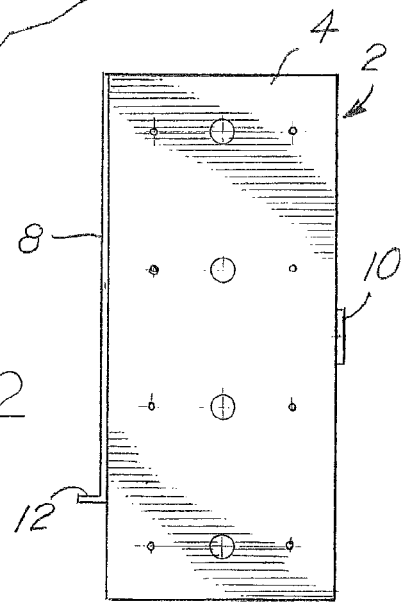
FIG.2

FIG. 3
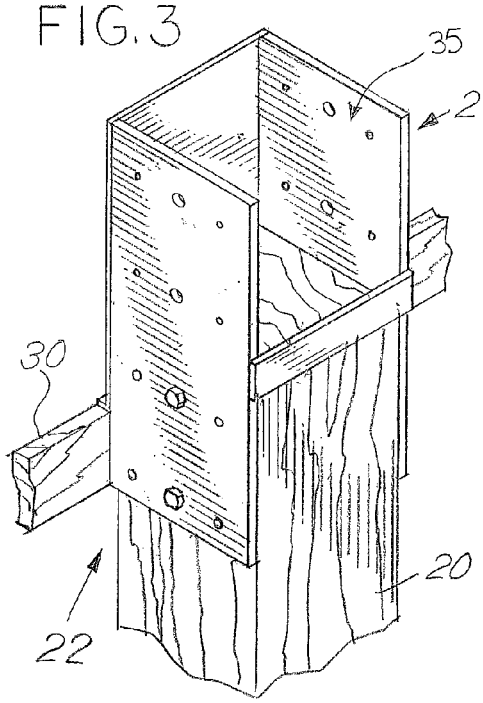
FIG. 5
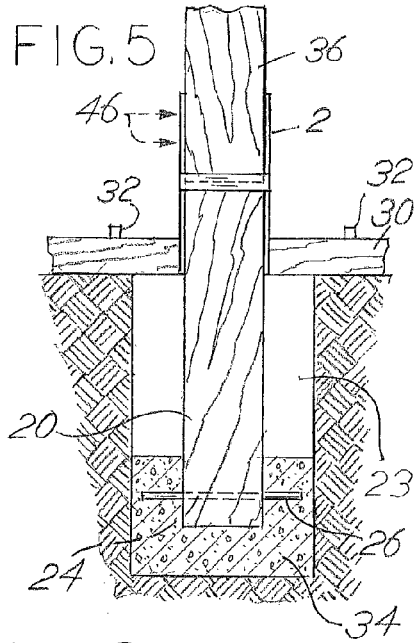
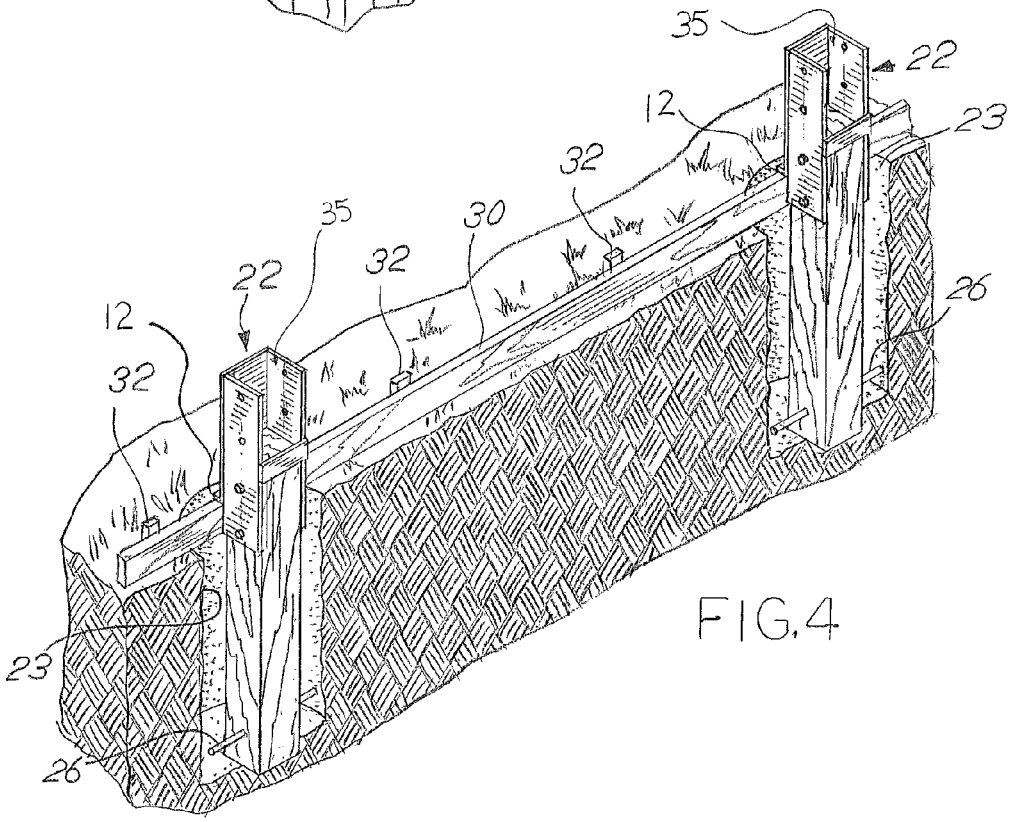
FIG. 4

POST FRAME BUILDING BRACKET AND METHOD OF USE

CROSS REFERENCE TO RELATED APPLICATIONS

This application claims the benefit of U.S. Provisional Application No. 60/889,329 filed Feb. 12, 2007, the disclosure of which is hereby incorporated by reference.

BACKGROUND OF THE INVENTION

Post frame buildings are laid out with string lines that define a rectangular shape and mark locations to place the posts which will be set into the ground. Concrete must be poured into the bottom of holes dug along the string line to form foundation pads to support weight the posts will have to bear once the building is completed. Getting the foundation pads level with respect to each other is difficult, meaning the final heights of the tops of the posts will be uneven. Once the concrete is poured into the bottoms of the holes, a construction crew must wait for the concrete to cure before placing the posts, causing a delay. After posts are placed on the foundation pads, they must be correctly positioned using a level on adjacent sides of the post to make sure posts are vertically plumb in both directions. Due to the fact that posts are often twisted or warped, this technique rarely places the tops of the posts directly above the bottoms of the posts, which affects how plumb and square the completed building will be. Once a worker believes he has a post true to the string line and perpendicular to the ground, boards that are staked into the ground must be tacked onto the post while someone holds the post in position. Positioning the post takes at least two workers a great deal of time to accomplish due to the labor of tacking on the boards, checking the post for level, and repositioning the post multiple times.

Depending on local building codes, holes around each post are either filled with concrete or soil once the post is positioned. Uplift is the force resulting from wind, which can lift buildings upward if not secured to the ground. Cleat boards are nailed to the end of a post that will be placed into the ground to make that end larger than the rest of the post, thereby increasing a post's resistance to uplift. A post with cleat boards and set in concrete has high resistance to uplift, but a large amount of cost is added if concrete is used to fill the holes, as required by some building codes. In a building where soil is used to fill postholes, the cleat boards provide moderate resistance to uplift.

SUMMARY OF THE INVENTION

The post bracket of this invention is for use in building post frame buildings. The post bracket has a first side plate, a second side plate, a back plate, and a front catch plate. The catch plate is located between the first and second side plates and substantially parallel to the back plate.

The bracket fits over a the top of a subgrade post to form a subgrade post assembly. The subgrade post assemblies extend into the ground and are supported upon and attached to skirt boards which outline the foot print for the building. The subgrade posts are anchored in the ground. After the posts are anchored in the ground, upper posts are placed in and pivotally engaged in the post brackets and laid on the ground. Adjacent upper posts then have girts and header boards attached to form a wall section. The wall section is then tilted upward with the upper posts pivoting into the post brackets and secured in their upright positions.

BRIEF DESCRIPTION OF THE DRAWINGS

FIG. 1 is a perspective view of the bracket of this invention;

FIG. 2 shows a side view of the bracket;

FIG. 3 is a view showing a bracket attached to a subgrade post;

FIG. 4 is a perspective view showing multiple brackets and subgrade posts attached to a skirt board;

FIG. 5 shows an elevational view of a subgrade post in the ground and a connected upper post with a piece of rebar embedded into a poured foundation pad;

DETAILED DESCRIPTION OF THE INVENTION

Figure 6:
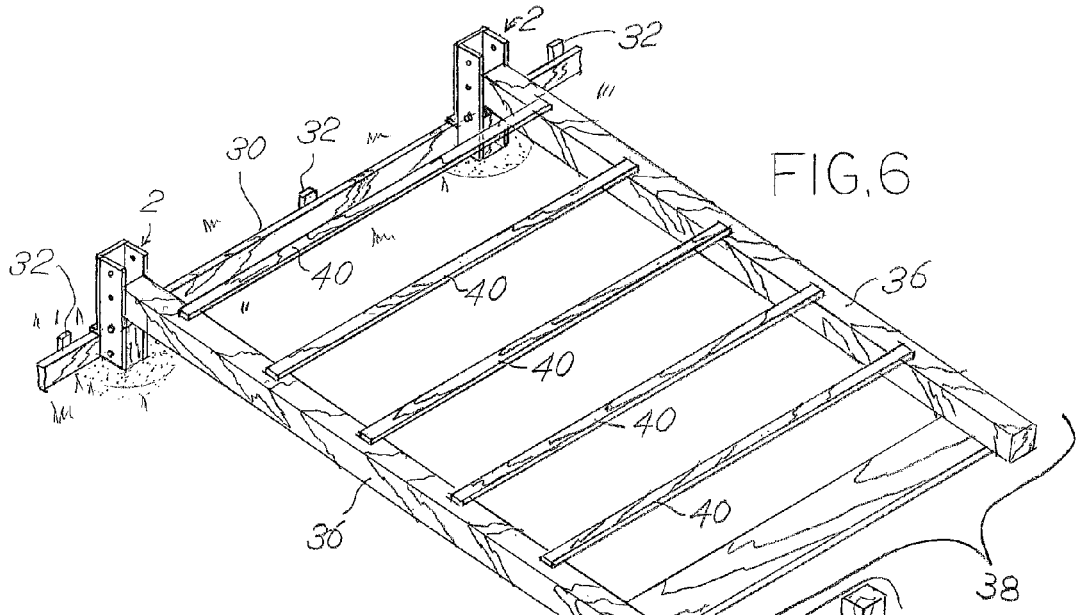
FIG. 6 shows a wall section on the ground.
Figure 7:
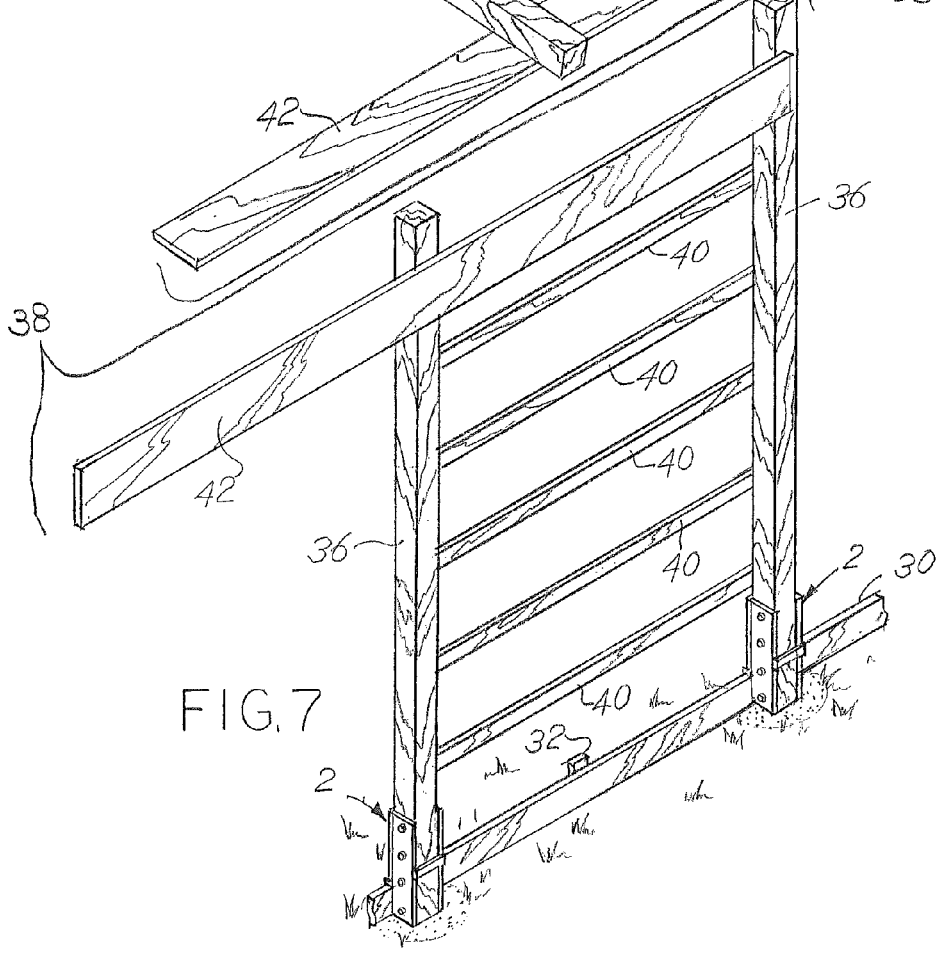
FIG. 7 shows a wall section after being lifted to vertical position.

A post bracket 2 of this invention has a first side plate 4, a second side plate 6, a back plate 8, and a catch plate 10. The first and second side plates 4, 6 are preferably made of ¼ inch steel having small holes 14 that can accept screws 17, and large holes 16 that can accept bolts 48. The catch plate 10 is preferably made of ⅛ inch steel. The back plate 8 is preferably made of 1/16 inch steel, has a lower ledge 12, and an upper surface 9. The ledge 12 has holes 18 which can accept screws 19. Bracket 2 may be formed by having the first side plate 4 welded at a right angle to the back plate 8 and the second side plate 6 welded at a right angle to the back plate 8, parallel to the first side plate 4. A catch plate 10 is welded between the first side plate 4 and the second side plate 6 approximately at the midpoint of the side plates 4, 6. The catch plate has an upper surface 13 that is below the upper surface 9 of the back plate.

The bracket is sized to fit over a subgrade post 20 as shown in FIG. 3 and permanently attached to form a subgrade post assembly 22. The subgrade post 20 has an upper surface 21. The bracket 2 is affixed to the subgrade post with screws 17 and bolts 48. The subgrade post is often a 6×6 inch or 4×6 inch wooden post as is commonly used in post frame buildings, but is not limited to those sizes or material. The subgrade post assembly 22 is sold as a unit. The subgrade post 20 preferably has a through bore 24 near the opposite end where the post bracket 2 is mounted which can accept a piece of rebar 26.

When a post frame building is to be built using post brackets 2, the perimeter of a building is laid out using the traditional technique of stretching strings across batt boards to form a rectangular shape. The ground is leveled and skirt boards 30 are held in place with stakes 32 driven into the ground, and the skirt boards 30 are equal distance from the leveled ground and define the perimeter of the building. A piece of rebar 26 is placed in the bore 24 in the subgrade post 20 before placing a subgrade post assembly 22 into the ground. Once that is completed, the subgrade post assemblies 22 are attached to the skirt boards 30, such that the subgrade posts 20 extend into the ground, as shown in FIG. 4, with ledges 12 resting upon the top of the skirt boards. Nails or screws 19 are driven or turned through holes 18 on the ledge 12 into the skirt boards 30 to hold the subgrade post assemblies 22 in place. At this point each subgrade post assembly 22 preferably has no contact with the ground and is suspended above the bottom of its respective posthole 23, as shown in FIG. 4. This method of attaching the subgrade post assemblies 22 to the skirt boards 30 ensures that all the subgrade posts 20 are at exactly the same height above the ground.

With subgrade post assemblies 22 suspended on skirt boards 30, as shown in FIG. 4, concrete is then poured into each posthole 23. This forms a foundation pad 34 that not only supports each subgrade post 20 from beneath, but also encases the subgrade post 20 to a desired height, preferably above the rebar 26, as shown in FIG. 5. In an application where building codes require postholes 23 be filled completely with concrete, doing so requires only one step of pouring concrete. This is different than the prior art which required construction crews to wait after pouring the foundation pad, position the post, then pour concrete on top of the foundation pad. Also, encasing the subgrade post 20 in concrete above the rebar 26 makes using cleat boards nailed onto the bottom of the subgrade post 20 unnecessary. This saves time compared to the prior art which required that construction crews take time to cut and nail cleat boards to each post to be set into the ground. When soil is used to fill postholes 23, more uplift resistance will be provided with the foundation pad 34 of this invention since the end of the subgrade post 20 will be encased in concrete that fills the entire bottom of the posthole 23, as shown in FIG. 5. This provides much more area to resist uplift than cleat boards which, do not fill the entire bottom of the posthole 23.

Once the subgrade post assemblies 22 are anchored by filling the postholes 23 with concrete or soil and concrete, they form a solid base on which to build. The anchored subgrade post assemblies 22 provide a solid base on which to attach upper posts 36 which will be used to support walls. To construct a wall section 38, two or more upper posts 36 are laid into post brackets 2, as shown in FIG. 6. The posts are laid on the ground toward the inside of the building. This allows girts 40 to be nailed onto what will be the outside of the wall section 38. A header board 42 may be attached near the tops of the upper posts 36 which will support roof trusses if they are to be spaced closer together than the upper posts 36. FIG. 6 shows two adjacent upper posts 36 forming a wall section 38, however, wall sections 38 may be built across more than two upper posts 36 if desired.

Building wall sections 38 on the ground saves a substantial amount of time, results in straighter walls, and is safer for construction crews. Use of ladders and scaffolding is greatly reduced when compared to traditional post frame construction, which means time will not be spent repositioning such equipment. The risk of falling while working high up on walls is also greatly reduced. Less labor is needed since one worker can line up each upper post 36 without need of someone else to hold it in position. Also the tops and bottoms of the upper posts 36 can be measured more easily, which ensures that the tops and bottoms of the upper posts 36 will be aligned, thereby producing straight wall sections. Building using post brackets 2 also allows different materials to be used for the upper post 36 and the subgrade post 20. Using two different materials is advantageous because lumber placed in the ground must be treated; traditional construction methods often used full length treated posts, which are weaker than non-treated lumber and more expensive.

Once the wall sections 38 are completed, they are lifted and tilted upward on the subgrade post assemblies 22 with the lower end of the upper posts fitting into the cavity 35 formed by back plate 8 and side plates 4, 6 behind catch plate 10. Catch plate 10 serves to retain the end of upper post 36 within the cavity 35 as the post is pivoted upwardly upon the raising of the wall section 38. Screws 17 are turned into holes 14 in the first and second side plates 4, 6 to temporarily hold the upper posts 36. With the upper posts 36 in position and held by screws 17, holes 46 are drilled through the upper posts 36 using holes 16 in the side plates 4, 6 as a guide to locate the holes drilled in the upper posts 36. Then bolts 48 are placed through holes 16 in the side plates 4, 6 to permanently hold the upper posts 36 in place. This process is repeated until all of the necessary wall sections 38 to complete a wall are made. Each wall of a building is formed the same way until four walls are standing. At that point, posts must be placed in the corners of the building.

The preferred embodiment described herein is illustrative as an example only and is not intended to limit or exhaust the scope of the present invention. Modifications and alterations may be made without departing from the scope of the invention.

What is claimed is:

1. A bracket for use with a subgrade post to support an upper post in a building sidewall comprising:

a back plate for preventing said post from leaning, said back plate having an upper surface;

a first side plate for guiding and supporting said upper post attached to said back plate; and a second side plate for guiding and supporting said upper post attached to said back plate, said second side plate substantially parallel to said first side plate;

a catch plate having an upper surface, said catch plate substantially parallel with said back plate and attached to said first and second side plates, said bracket fitted about and adapted to be attached to said subgrade post, said back side plates and catch plate extending above said subgrade post to form a receptive cavity defined by said back, side, and catch plates for pivotally receiving said upper post of said building sidewall said upper surface of said catch plate being below said upper surface of said back plate;

wherein said back plate has an outturned ledge positioned below an upper surface of the subgrade post serving as a means for supporting said bracket when positioned in the ground.

2. The bracket as claimed in claim 1, wherein at least one of said back plate, said first side plate or second side plate is attachable to said post.

* * * * *